United States Patent [19]

Ohumi et al.

[11] 4,231,347

[45] Nov. 4, 1980

[54] FUEL PRESSURE REGULATING VALVE

[75] Inventors: Takeharu Ohumi, Toyota; Masaru Tsunekawa, Fujioka, both of Japan

[73] Assignee: Aisin Seiki Kabushiki Kaisha, Kariya, Japan

[21] Appl. No.: 970,931

[22] Filed: Dec. 19, 1978

[30] Foreign Application Priority Data

Dec. 19, 1977 [JP] Japan ..... 52/170996

[51] Int. Cl.[3] ..... F02D 1/04

[52] U.S. Cl. ..... 123/512; 137/510; 251/121

[58] Field of Search ..... 137/510, 508, 625.3; 123/140 MP, 140 MC; 251/121

[56] References Cited

U.S. PATENT DOCUMENTS 4,109,561 8/1978 Junck ..... 137/625.3 X

*Primary Examiner*—Harold W. Weakley

*Attorney, Agent, or Firm*—Finnegan, Henderson, Farabow, Garrett & Dunner

[57] ABSTRACT

A fuel pressure-regulating valve for an electronic fuel injection system for internal combustion engines including a body member having an inlet port and an outlet port, a diaphragm dividing the interior of the body member into two chambers, a piston secured to the diaphragm and having a hollow stem with a fuel passageway therethrough, a valve responsive to the movement of the piston for controlling the communication between the inlet port and outlet port, and a bushing inserted securely in the hollow stem of the piston. Aligned apertures in the hollow stem and the bushing provide communication between the inlet port and the valve, the outer periphery of the bushing adjacent the apertures therein being flattened to provide gaps between the bushing and the hollow stem for preventing reduction of flow through the aligned aperture in case of slight misalignment of the apertures.

2 Claims, 6 Drawing Figures

FUEL PRESSURE REGULATING VALVE

BACKGROUND OF THE INVENTION

1. Field of the Invention

This invention relates generally to fuel pressure-regulating valves, and more particularly to a fuel pressure-regulating valve for use in an electronic fuel injection system for internal combustion engines.

2. Description of the Prior Art

In an electronic fuel injection system for internal combustion engines, a fuel pressure-regulating valve generally regulates fuel pressure to the fuel injectors at a predetermined pressure level, and returns extra fuel to a fuel tank through a fuel return line. The regulating valve comprises a piston which is secured to a movable wall such as a diaphragm and is provided with a hollow stem. The hollow stem includes an aperture acting as a fuel passageway.

The regulating valve further comprises a bushing which is inserted securely in the hollow stem in order to ensure the movement of the piston in the axial direction. The bushing includes an aperture communicating with the fuel passageway in the hollow stem.

In a conventional fuel regulating valve, as described above, however, there is the drawback that a small displacement in the rotational direction may be produced between the piston and the bushing when the bushing is inserted into the hollow stem of the piston. As a result, the open area of the fuel passageway of the piston is reduced and the quantity of flow through the passageway decreases. Furthermore, when the regulating valve is employed in an electronic fuel injection system for internal combustion engines, it is difficult to ensure a constant air-fuel mixture, thus impairing the reliability of the regulating valve.

SUMMARY OF THE INVENTION

It is, therefore, a principal object of the present invention to improve fuel pressure-regulating valves obviating the conventional drawbacks, as described above.

It is another object of the present invention to provide a fuel pressure-regulating valve for use in an electronic fuel injection system, which regulates fuel pressure supplied to fuel injectors at a predetermined pressure level with greater assurance.

Other objects and their attendant advantages will become apparent as the following detailed description is read in conjunction with the accompanying drawings.

To achieve the objects, and in accordance with the purpose of the invention, as embodied and broadly described herein, the fuel pressure-regulating valve of the invention for an electronic fuel injection system of an internal combustion engine having an induction passage, a fuel supply line and a fuel return line, comprises a body member having a pressure port for connection to the engine induction passage, an inlet port for connection to the fuel supply line, and an outlet port for connection to the fuel return line; a flexible diaphragm for dividing the interior of the body member into a first chamber communicating with the pressure port and a second chamber communicating with the inlet port; a piston secured to the diaphragm and having a hollow stem extending into the second chamber; valve means for controlling communication between the second chamber and the outlet port, the valve means including a valve member responsive to the movement of the piston and an elongated hollow seat member located in the hollow stem and having one end forming a valve with said valve member and the end remote from the valve member secured to the outlet port, the diaphragm being biased for normally closing said valve; a bushing secured in the hollow stem and slidable upon the outer periphery surface of the seat member; aligned apertures in the hollow stem and the bushing providing communication between the second chamber and the valve; and means for preventing reduction in communication through the aligned apertures by a small rotational displacement of the bushing with respect to the hollow stem.

Preferably the means for preventing reduction in communication through the aligned apertures comprises flattened portions in the outer periphery surface of said bushing adjacent the apertures therein forming gaps between said hollow stem and said bushing.

The accompanying drawings, which are incorporated herein and constitute a part of this specification, illustrate one embodiment of the invention and, together with the description, serve to explain the principles of the invention.

DETAILED DESCRIPTION OF THE PREFERRED EMBODIMENT

Figure 1:
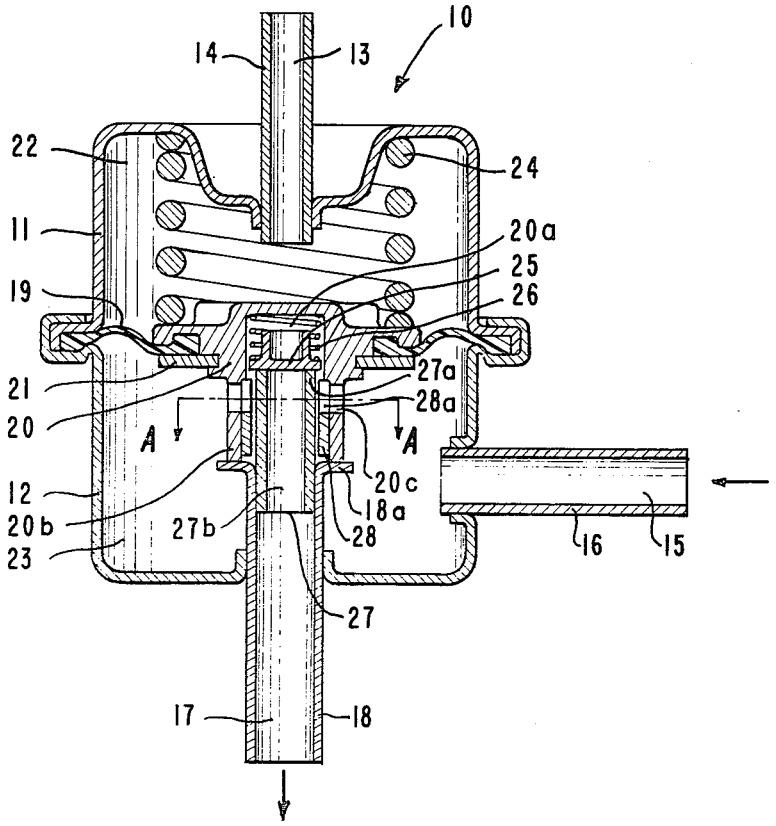
FIG. 1 is a vertical sectional view of a fuel pressure-regulating valve in accordance with the present invention.

Referring now more particularly to FIG. 1, a fuel pressure-regulating valve, numbered generally as 10, of the present invention includes a first body member 11 and a second body member 12, which are combined with each other by any suitable connecting means, such as crimping. The first body member 11 is provided with a pipe member 14 having a pressure (vaccum) port 13, while the second body member 12 is provided with a pipe member 16 having a inlet port 15 and a pipe member 18 having an outlet port 17.

An annular flexible diaphragm 19 is rigidly secured at the outer periphery thereof between the first and second body members 11 and 12. The diaphragm 19 has a piston 20 which is integrally secured on the central portion of the diaphragm 19 by a plate 21. The interior of the first and second body members 11 and 12 is divided into a first chamber 22 and a second chamber 23, respectively, by the diaphragm 19 and the piston 20. The pressure port 13 communicates with the first chamber 22, while the inlet port 15 communicates with the second chamber 23.

Positioned within the first chamber 22 is a compression spring 24 which biases the piston 20 toward the second chamber 23, thereby bringing a hollow stem **20*b* of the piston 20 in contact with a flange portion 18*a* at the upper end of the pipe 18 and maintaining the piston 20** in the normal or rest position.

The piston 20 is provided with a central hollow portion 20*a* in which a valve member 25 is located so as to be in sealing contact with a valve seat 27*a* at the tip end surface of a seat member 27 inserted in the pipe member 18. A relatively weak coil spring 26 is positioned in the hollow portion 20*a* so as to urge the valve member 25 to engage the valve seat 27*a*.

A bushing 28 is securely inserted in the hollow stem 20*b* of the piston 20 to be movable together with the piston in response to the movement thereof in the axial direction. The bushing 28 is made of a suitable metal material whose coefficient of friction is small so that the bushing may slide on the outer peripheral surface of the seat member 27. When the bushing 28 moves upward, it engages an annular shoulder on the valve member 25 and lifts it overcoming the force of the spring 26. The valve member 25 is thus moved into the open position from the closed position shown in FIG. 1. In this way, by inserting the bushing 28 in the hollow stem 20*b* of the piston 20, the piston 20 and valve member 25 move surely upward and downward in the axial direction.

The hollow stem 20*b* of the piston 20 is provided with apertures 20*c* acting as fuel passageways, and the bushing 28 is provided with apertures 28*a* communicating with the apertures 20*c*. The inlet port 15 communicates with the outlet port 17 through both apertures 20*c*, 28*a* and a fuel passageway 27*b* in the seat member 27 when the valve member 25 is maintained in the open position.

Figure 2:
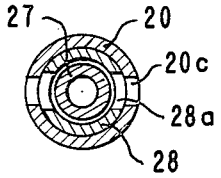
PRIOR ART FIG. 2
FIG. 2 and FIG. 3 are sectional views taking along A—A of FIG. 1 showing the conventional combination of the piston and the bushing.
Figure 3:
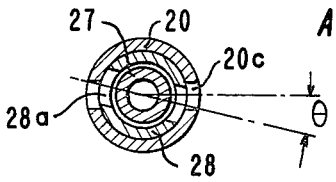
FIG. 3 PRIOR ART

FIGS. 2, 3, 4, and 5 show sectional views taking along A—A of FIG. 1, wherein FIG. 2 and FIG. 3 show the conventional condition of the combination of the piston 20 and the bushing 28. When a displacement, such as angle $\theta$ is produced in the rotational direction as shown in FIG. 3 from the formal condition of the combination of the piston and bushing in FIG. 2, the open area of the aligned apertures 20*c* is reduced and the flow quantity through the apertures 20*c* decreases. Such displacement may occur, for example, when the bushing 28 is inserted into the stem 20*b*.

Figure 4:
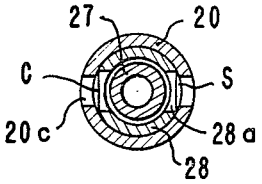
FIG. 4 and FIG. 5 are sectional views corresponding to that of FIG. 2 and FIG. 3, respectively, but showing the combination of the piston and bushing in accordance with the present invention.
Figure 5:
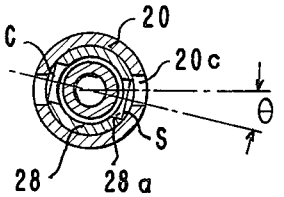

FIG. 4 and FIG. 5 show the combination of the piston and bushing in accordance with the present invention. Portions of the periphery of the bushing 28 are flattened and the apertures 28*a* are formed in a small diameter portion(s) of the bushing thus produced. A gap C therefore results between the apertures 20*c* and the small diameter portion S at each aperture 28*a*. Accordingly, even if displacement in the amount of angle $\theta$ is produced in the rotational direction as shown in FIG. 5 from the normal condition of the combination of the piston 20 and bushing 28 shown in FIG. 4, the open area of the apertures 20*c* is not reduced and the flow quantity of fuel is prevented from decreasing. That is to say, when the bushing 28 is inserted in the hollow stem 20*b* of the piston 20, a limited displacement in the rotational direction is tolerated without reducing the fuel flow.

Figure 6:
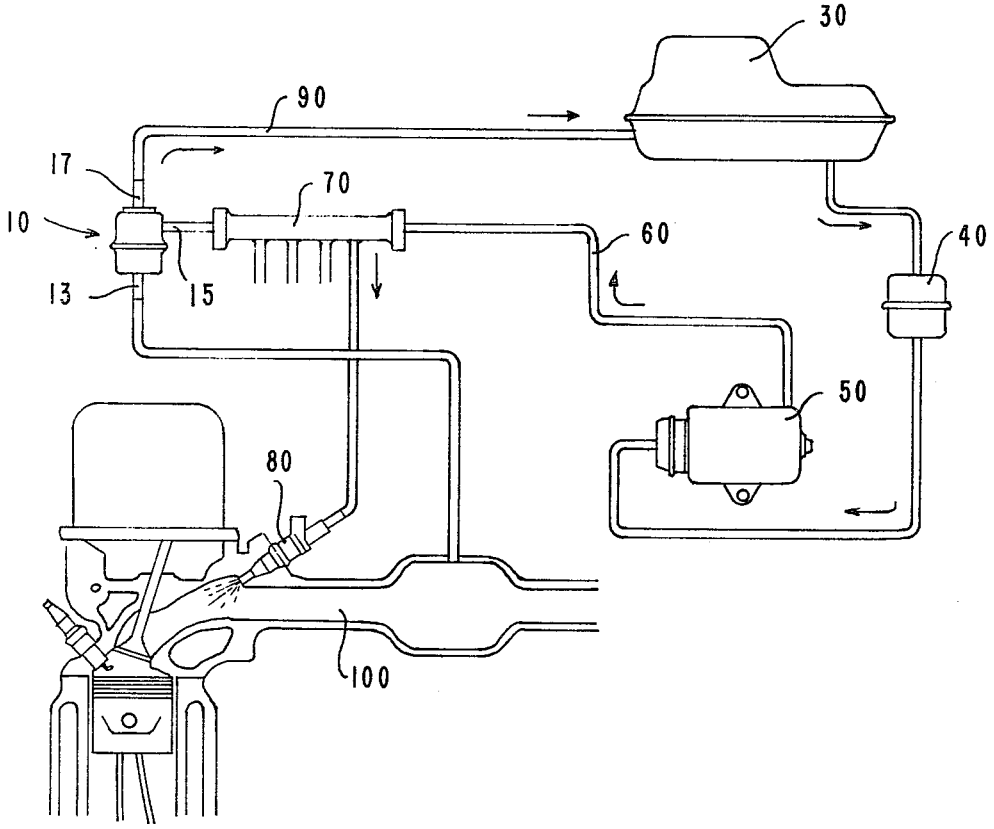
FIG. 6 is a schematic view of an electronic fuel injection system incorporating the fuel pressure-regulating valve of FIG. 1.

Referring now to FIG. 6, an electronic fuel injection system incorporating the fuel pressure-regulating valve 10 is illustrated schematically. A fuel pump 50 receives fuel through a fuel filter 40 from a fuel tank 30. The fuel pump 50 supplies fuel through a fuel supply line 60 to a delivery pipe 70.

In the fuel pressure-regulating valve 10, according to the present invention, since the vacuum port 13 is connected to an engine induction passage 100, vacuum is supplied to the first chamber 22 through the vacuum port 13. As a result, the diaphragm is exposed on one side face thereof to pressure Pi existing in the engine induction passage 100. Since the inlet port 15 is connected to the delivery pipe 70, fuel is supplied to the second chamber 23 through the inlet port 15. As a result, the diaphragm 19 is exposed on the other side face thereof to fuel pressure P2 existing in the fuel supply line 60. Since the outlet port 17 is connected to the fuel tank 30 through the fuel return line 90, extra fuel is returned to the fuel tank 30. Each of the injectors 80 contains an electrically actuated valve which is opened by an electronic timing device in synchronism with engine speed. The valves are opened for varying periods of time as a function of the engine operating conditions.

In the electronic fuel injection system, as above-described, the time duration which the injectors 80 discharge fuel into the induction passage 100 is generally determined by the quantity of air per engine cycle regardless of the pressure in the induction passage 100. Therefore, in order to get the constant air-fuel mixture it is necessary to maintain the differential pressure across the injectors at a constant level at all times. Accordingly, the fuel pressure-regulating valve 10 regulates the fuel pressure supplied to the injectors 80 in response to the differential pressure between the fuel pressure P2 in the fuel supply line 60 and the pressure P1 in the induction passage 100.

In operation, the piston 20 secured to the diaphragm 19 is normally biased by the force of the spring 24 into the normal or closed position as shown in FIG. 1. The valve member 25 is therefore normally seated on the valve seat 27*a* and the communication between the inlet port 15 and outlet port 17 is interrupted. When the fuel pressure P2 in the second chamber 23 exceeds the pressure P1 in the first chamber 22 by a predetermined differential pressure, the piston 20 secured to the diaphragm 19 moves upward overcoming the biasing force of the spring 24. As a result, since the bushing 28, inserted securely in the piston 20, comes in contact with the valve member 25 and moreover lifts it, the valve member 25 is released from the valve seat 27*a* and is maintained in the open position, thereby providing the communication between the inlet port 15 and the outlet port 17. Therefore, any extra fuel in the second chamber 23 is supplied to the outlet port 17 through the aperture 20*c* of the piston 20, the aperture 28*a* of the bushing 28, and the passage 27*a* of the seat member 27, and then is returned to the fuel tank 30 through the fuel return line 90. Thus, the fuel pressure-regulating valve 10 insures the constant differential pressure across the injectors 80.

While a preferred embodiment of the invention has been described, it will be readily apparent to those skilled in the art that various changes and arrangements can be made to accomplish the objects of the invention without departing from the scope and spirit of the appended claims.

What is claimed is:

1. A fuel pressure-regulating valve for an electronic fuel injection system of an internal combustion engine having an induction passage, a fuel supply line and a fuel return line, the valve comprising:

a body member having a pressure port for connection to the engine induction passage, an inlet port for connection to the fuel supply line, and an outlet port for connection to the fuel return line;

a flexible diaphragm for dividing the interior of said body member into a first chamber communicating with said pressure port and a second chamber communicating with said inlet port;

a piston secured to said diaphragm and having a hollow stem extending into said second chamber;

valve means for controlling communication between said second chamber and said outlet port, said valve means including a valve member responsive to the movement of said piston and an elongated hollow seat member located in said hollow stem and having one end forming a valve with said valve member and the end remote from said valve member secured to said outlet port, said diaphragm being biased for normally closing said valve;

a bushing secured in said hollow stem and slidable upon the outer periphery surface of said seat member;

aligned apertures in said hollow stem and said bushing providing communication between said second chamber and said valve;

said bushing having flattened portions in its outer periphery surface adjacent the apertures therein, thereby forming gaps between said hollow stem and said bushing for preventing reduction in communication through said aligned apertures by a small rotational displacement of said bushing with respect to said hollow stem.

2. The pressure-regulating valve of claim 1 wherein the coefficient of friction of said bushing is small.

* * * * *